US005997551A

United States Patent [19]

Disney

[11] Patent Number: 5,997,551

[45] Date of Patent: Dec. 7, 1999

[54] MEAGHER OVARY FLUTE

[76] Inventor: Harry Disney, 131 Alaska Rd. N., Belgrade, Mont. 59714

[21] Appl. No.: 09/233,350

[22] Filed: Jan. 19, 1999

[51] Int. Cl.[6] ..... A61D 1/06

[52] U.S. Cl. ..... 606/137

[58] Field of Search ..... 606/135, 137, 606/108

[56] References Cited

U.S. PATENT DOCUMENTS 4,662,869 5/1987 Wright ..... 604/22
5,403,276 4/1995 Schnecter et al. ..... 604/22

*Primary Examiner*—Michael Buiz
*Assistant Examiner*—Vy Q. Bui

[57] ABSTRACT

A plunger-in-tube surgical instrument that, by the plunger's (10) back and forth action, can expose or guard a penetrating, cutting head (13) to safely enter body cavities, can allow rapid air introduction into said body cavity, can open a specialized aperture (5 and 6) on the tube (1) wall for introduction and restraint of pendunculated tissues, can severe said tissue attachments by shearing between plunger and tube wall, cutting guillotine-fashion (FIG. 5) along said tube wall, and just pulling back to severe attachments against a sharpened spot (7) on said tube wall, can interchange first plunger with other specialized plungers while pedunculated structures are restrained by said tube, and can store severed structures in said tube for removal from said body cavities.

1 Claim, 12 Drawing Sheets

MEAGHER OVARY FLUTE

BACKGROUND—FIELD OF INVENTION

This invention relates to surgical instruments designed for mammalian sterilization.

BACKGROUND—DESCRIPTION OF PRIOR ART

Because of the internal location of the primary sex organs in females of any species, veterinarians usually must resort to major, surgical procedures to locate, isolate, and remove ovaries. To humanely perform sterilizations by ovary removal, much time and thought has gone into instrumentation, handling equipment, protocols, etc. to save both time and money.

To overcome the expense and disadvantages of general anesthesia in larger animal species, veterinarians use small incisions to surgically invade the patient through the abdominal wall and gain access to the ovaries. It has also been possible in the female horse to surgically approach the ovary from the backside. A mare has a large enough vagina for a surgeon to introduce his hand, make an incision in the top wall of the vagina, and guide cutting instruments effectively for ovary removal. Although the reproductive structures of the cow are easily palpated by the veterinarian inserting his hand into the rectum, the vaginal orifice and canal of a cow are too small to allow entrance of a hand unless the cow is very close to delivering a calf. Thus, veterinarians have devised instruments to penetrate the vaginal wall and to sever the ovarian attachments using a hand placed rectally for guidance.

To ovariectomize or "spay" cattle, there are at least two instruments commonly found in bovine practice today. One is the "German Needle", a metal rod with a three inch portion bent at a right angle for a handle on one end and a front end that has been flattened into a spade shape with the point of the spade forward. A tear-drop shaped hole, large enough for an ovary to pass through, occupies the flattened spade end of the "German Needle". Both the narrow end of the hole and the point of the spade end are sharpened. When the "needle" is passed up the vaginal canal and thrust into the cow's body cavity, the operator uses his other hand, placed per rectum, to guide the ovary through the aperture. While holding the ovary with the hand in the rectum, a pull backward cuts the ovary free as the sharpened area of the hole severs the ovarian ligamentous attachment. Some undesireable results from using this instrument are that the unguarded point of the "needle" can get trapped in folds of vaginal wall tissue during introduction causing vaginal wall damage and misdirection of the instrument. Too much tissue can tear instead of being neatly cut if the instrument pulls more than it cuts. The guiding hand in the rectum must maintain some pressure on the ovary to stabilize the ovary during the cutting procedure. There is no certain way to remove the freed ovaries from the body cavity, and often the ovaries will remain in the body cavity to continue to produce unwanted hormones.

In the 1970's at Colorado State University, Kimberling and Rupp developed the "K-R Spay Device", a carefully machined instrument primarily consisting of a tube within a tube. Each tube has matching, oval-shaped holes. When the holes are aligned, the tubes allow the ovary to be pressed in to the center of the instrument, and cutting begins as the inner tube is rotated to scissor the entrapped tissue from both ends of the orifice. An internal plunger forces the ovary forward for storage in the front end of the internal tube.

Should the instrument be too dull to complete it's cutting action, the internal plunger can crush the ovary loose. The K-R tool must be carefully manufactured lest it also do more tearing and crushing of tissue than cutting. The veterinary malpractice claims attest to the difficulty of guiding only the ovary into the cutting chamber with the rectally placed hand. Sections of rectal tissue, ovarian blood vessels, and small intestine have been inadvertantly cut leading to fatalities due to hemorrage and to peritonitis from fecal contamination. The cattle to be spayed must be held off food and water for at least 24 hours prior to the surgery to allow the operator room in the abdomen to manipulate the instrument. Although the guarded penetrating point of the K-R Tool is an improvement over the "needle" for passage through the vagina, it's blunt design makes it more difficult and traumatic to penetrate the vaginal wall.

OBJECTS AND ADVANTAGES

Accordingly, some objects and advantages of my invention are that unlike the "German Needle", the Meagher Ovary Flute will have a guarded, sharp, penetrating point. Once the ovary is introduced into the instrument, the instrument effectively holds the ovaries for cutting, and the ovaries are retained for complete removal from the animal. The surgeon can choose to cut the ovary free in a pulling motion as with the "German Needle", but he will have two more options for how he cuts the ovary free. Utilizing the shearing action of the plunger or the guillotine action with the sharpened edge of the plunger head provides options less traumatic to the cow and to the ovarian tissue. The Meagher Ovary Flute is more adaptable to new techniques than just pruning off ovaries.

Unlike the K-R tool, the Meagher Ovary Flute will allow the rapid introduction of outside air into the peritoneal cavity. As the air enters, the intestines sink down and away from the ovaries. The "air cap" makes it quicker to find the ovaries and less likely to entrap bowel loops in the cutting chamber. The present invention has fewer parts and does not have to be as finely machined to perform. The Meagher Ovary Flute could even be constructed of plastic except for the distinct cutting surfaces, and the parts will be easily interchangeable. After fitting an ovary into the chamber, no digital pressure is required to stabilize it during the cutting processes which removes the dangers of pressing the wrong tissues inadvertantly into the cutting surfaces. The present instrument has fewer sharp edges exposed to the viscera when used properly. Because cleanliness is a definite necessity, the Meagher Ovary Flute is completely disassembled by just pulling the plunger out to expose all surfaces to cleaning and disinfectants.

The Meagher Ovary Flute's simple design will easily initiate some newer instrumentation to be used for an increasing number of tasks where ovary isolation, stabilization, and/or nondamaged retrieval are necessary. The ovaries can even be held in the instrument while it is disassembled, reassembled, or center parts interchanged. Of course, the instrument may be adapted to other pedunculated structures.

DRAWING FIGURES

In the drawings, closely related figures have the same number but different alphabetic suffixes. The forward end of the instrument, the part that will be inside the body cavity, is toward the viewer's right in all views.

REFERENCE NUMERALS IN DRAWINGS

Figure 1:
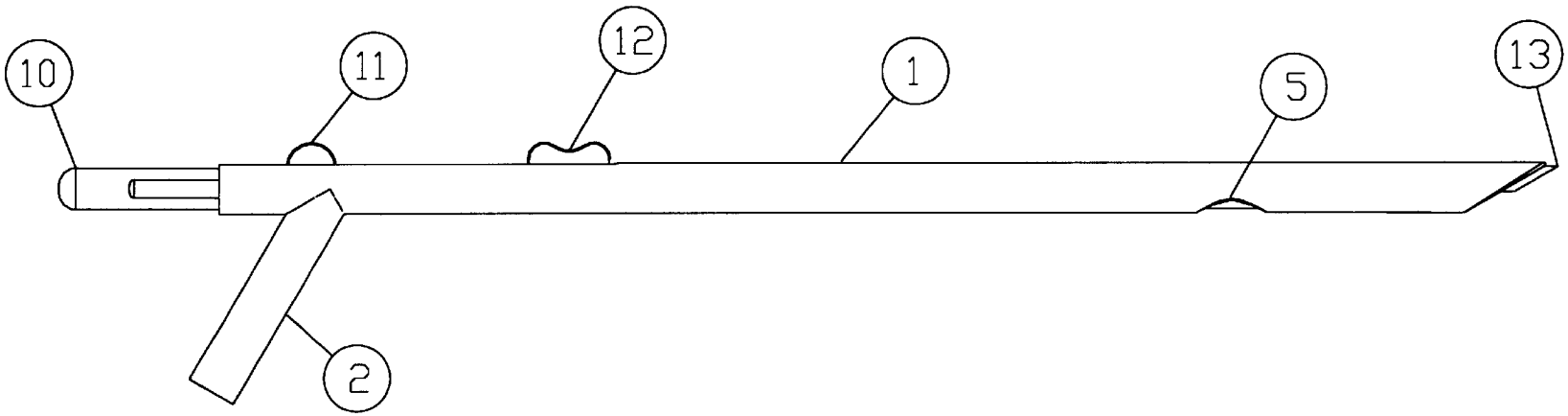
FIG. 1 shows a lateral view of the assembled instrument with the plunger fully engaged to expose the plunger cutting head.
Figure 2:
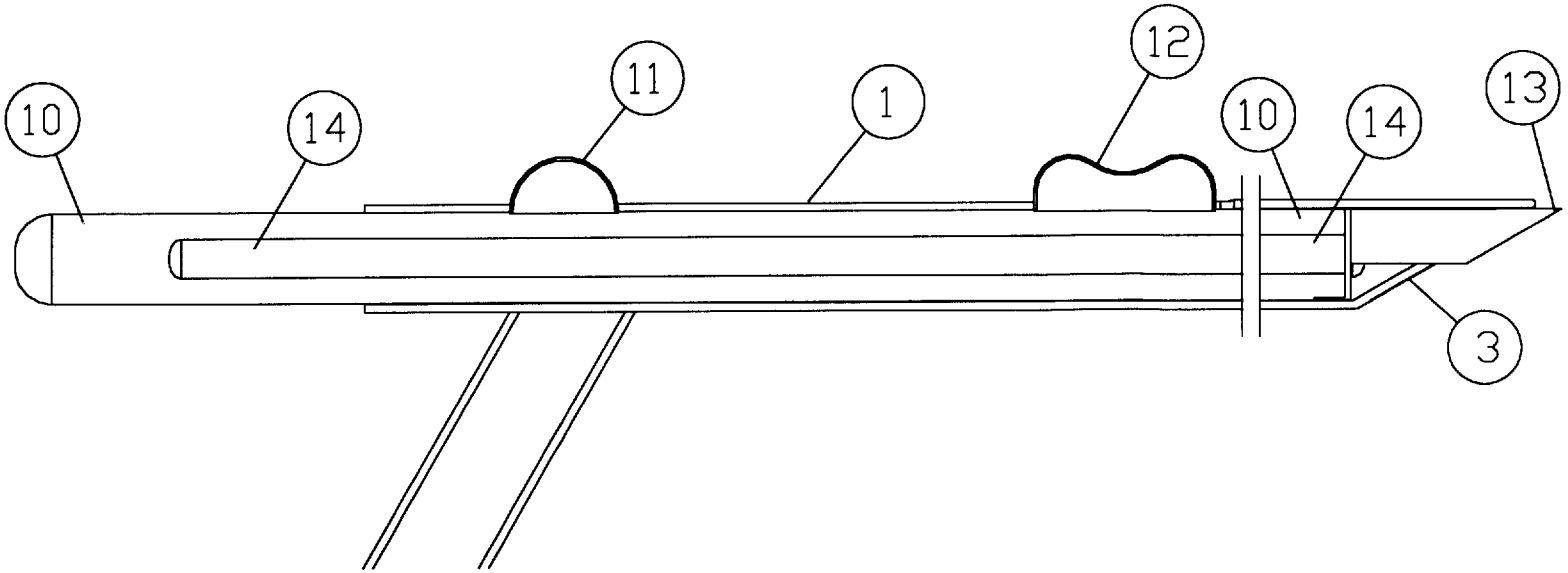
FIG. 2 shows two enlarged, side view sections of the instrument with the tube portion cut in half to expose the flattened surface on the plunger, the thumb tabs protruding from the top of the plunger, and the position of the plunger cutting head in the penetrating position.
Figures 3, 3A, 3B:
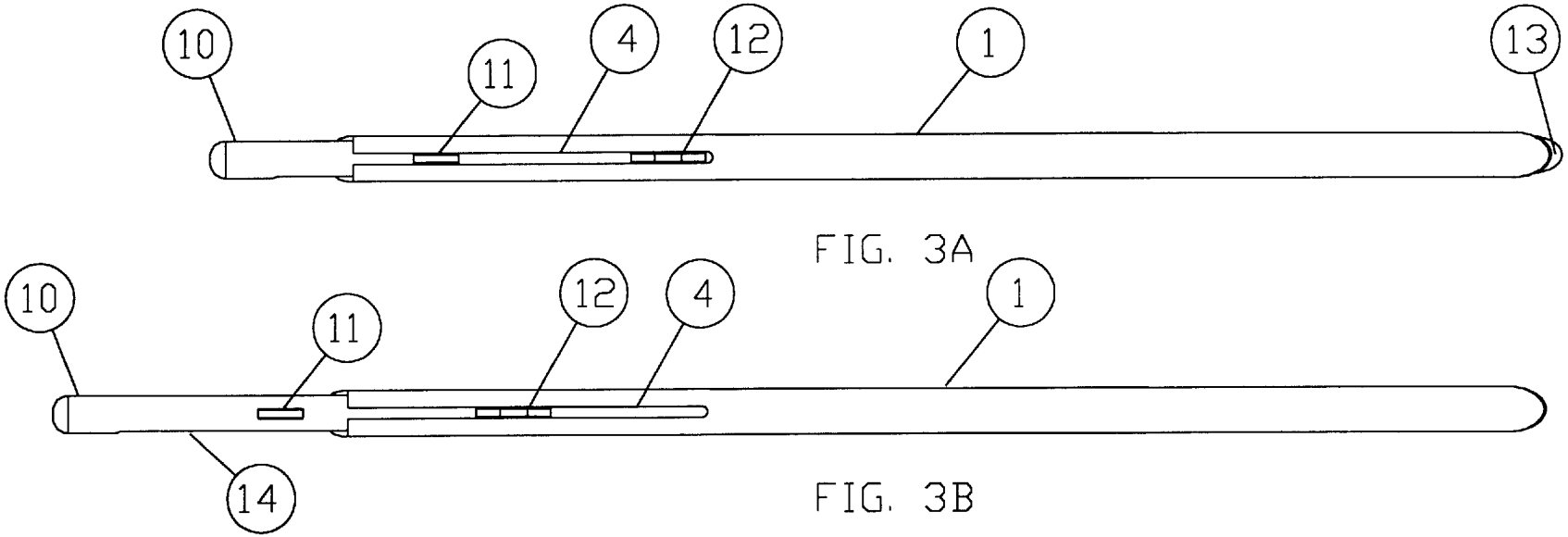
FIG. 3A is the top view of the fully engaged instrument.
FIG. 3B is the top view of the instrument to show the thumb tabs as they travel back in the guiding slot and the appearance of the flattened side of the plunger.
Figure 4:
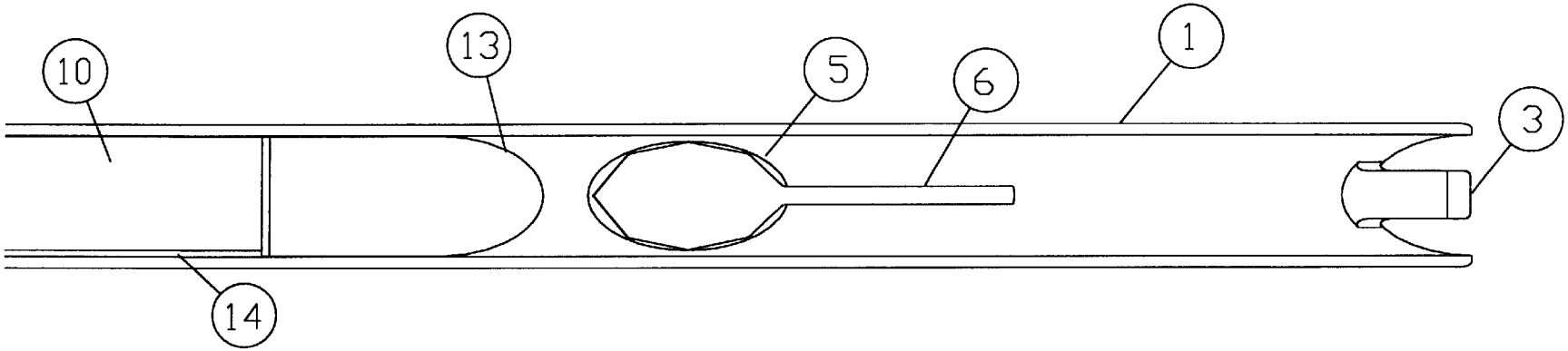
FIG. 4 is a top view of the forward part of the instrument with the tube portion cut in half to expose the retracted plunger cutting head and the tube aperture with communicating slot.

| | |
|---|---|
| 1 tube | 10 plunger shaft |
| 2 handle | 11 back thumb tab |
| 3 retainer tab | 12 front thumb tab |
| 4 thumb tab guide slot | 13 plunger cutting head |
| 5 aperture | 14 flattened area on plunger side |
| 6 communicating slot | 15 sharpened area of plunger head |
| 7 cutting edge bevel of slot | |

Summary

In accordance with the present invention a surgical sterilization instrument comprises a tube with a hole and communicating slot in it's side to receive tissue, hold tissue, sever the tissue's attachments to the body, and retrieve the tissue; and a plunger fixed with a tip capable of both aiding penetration of the instrument into the body cavities and cutting off tissue introduced into the tube's lumen.

Description

The two primary parts of the Meagher Ovary Flute are a tube 1 and an internal plunger 10. The tube has a short handle 2 extending at an angle from the open back. The tube's front end is cut off at a diagonal with the long part of the diagonal on the opposite side of the tube from the handle. A short retainer tab 3 is left on the short side of the diagonal and is bent upward to partially occlude the lumen of the tube. A few inches back from the tube front, on the same side as the handle, a round hole 5 is cut through the tube wall with a communicating slot 6 extending forward. Importantly, the forward end of the slot is sharpened to a cutting edge 7. At the back of the tube, a guiding slot 4 through the wall opposite the handle extends forward several inches and is wide enough to accomodate the plunger tabs.

The plunger assembly is long enough to fill the tube's length with some portion extending out the back. Fitted at the forward end of the plunger is a concave, cutting head 13 that fits securely against the inside of the tube, is sharpened to a point, and has sharpened side edges 15 beveled towards it's outer surface. The cutting point is diagonal when viewed from the side, at a slightly sharper angle than the tube bevel, and can extend out the front of the tube far enough to puncture membranous tissues. Note the cutting point, as it is pressed forward, surrounds the retainer tab 3 at the front of the tube to leave the tab undisturbed. Two different shaped thumb tabs 11 and 12 protrude from the plunger on the same side as the longest point of the cutting blade. Both of these thumb tabs will slide into the tube's guide slot 4. The thumb tabs keep the cutting head 13 from rotating unknowingly out of position and give the surgeon a feel for the position of the plunger head inside the tube. Although the plunger shaft should fit closely to the inside of the tube, a flattened strip 14 along part of the plunger's side is needed to provide an air channel between plunger and tube.

Operation

Figure 5:
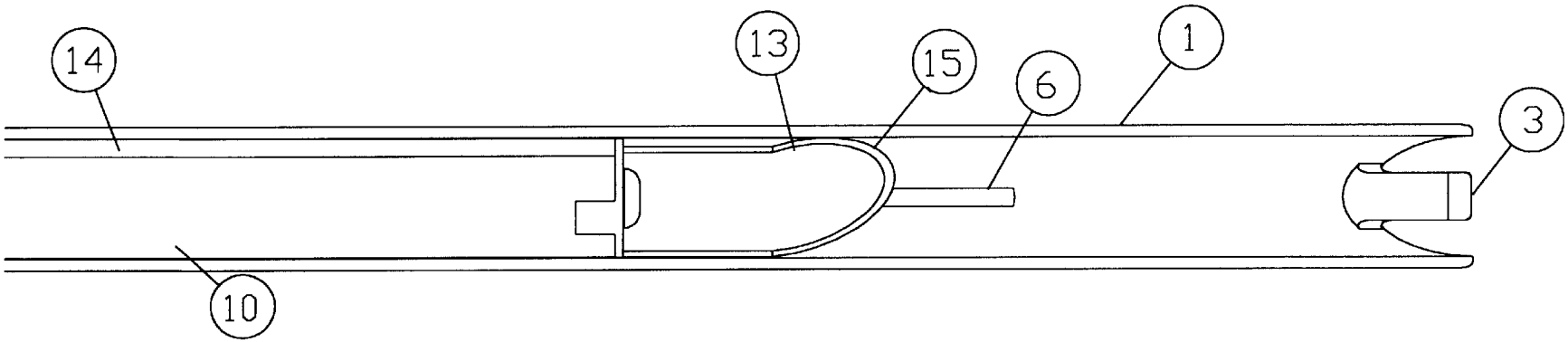
FIG. 5 is the same cutaway view as FIG. 4 but shows the plunger cutting head rotated to a guillotine cutting position along the aperture's communicating slot.
Figure 6:
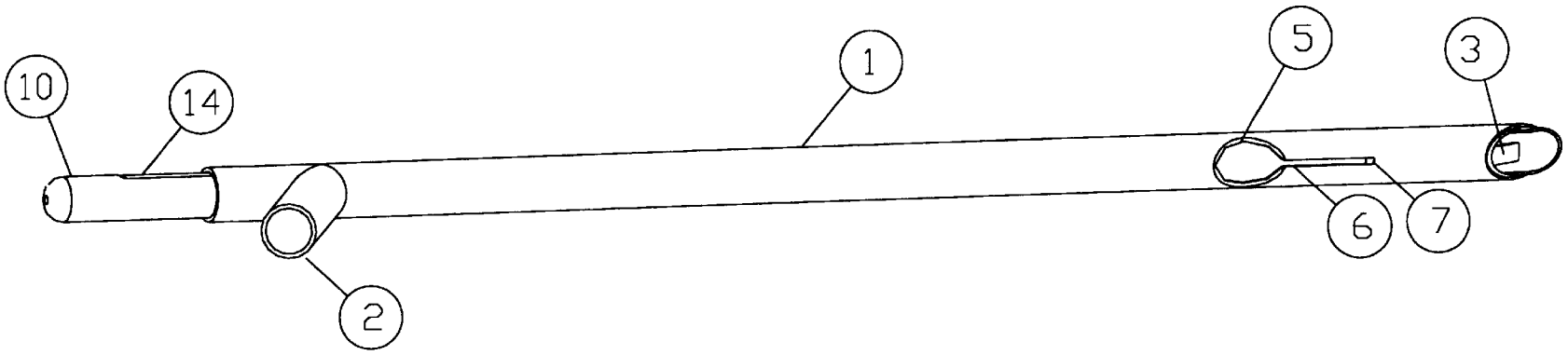
FIG. 6 is the assembled instrument, plunger retracted, with the handle rotated an eighth of a turn from the bottom toward the viewer.
Figure 7:
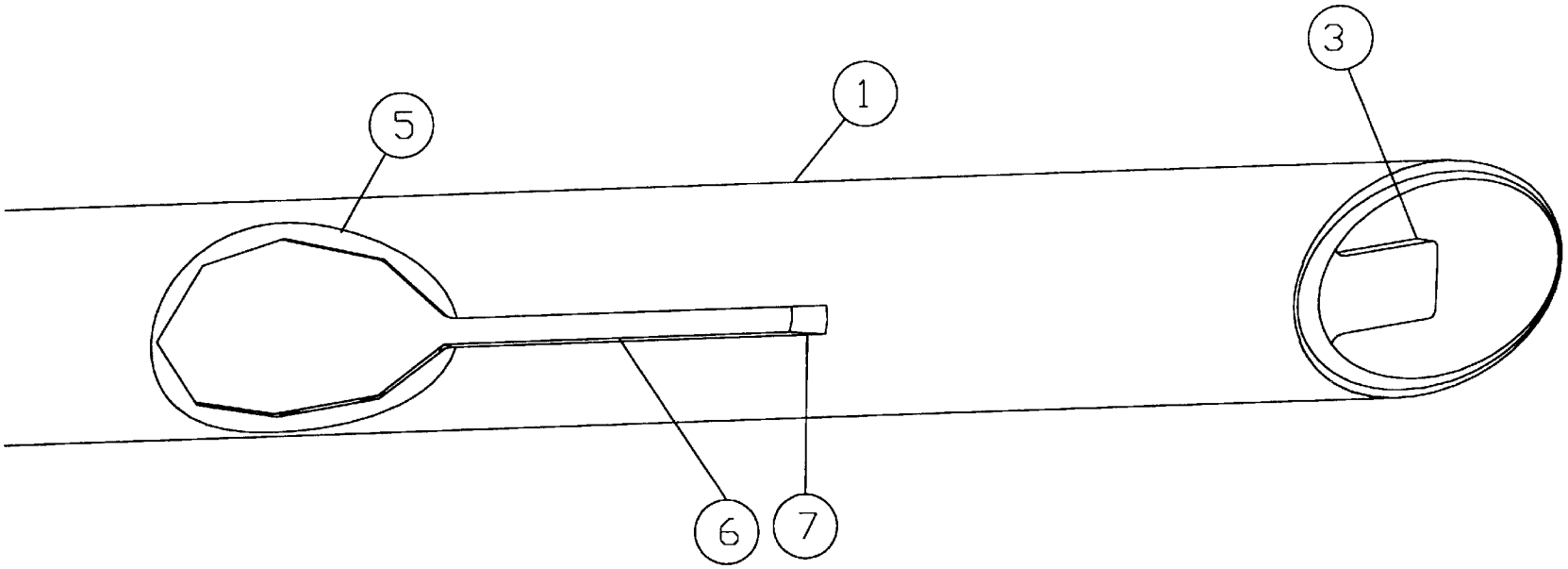
FIG. 7 is an enlarged view of the front end section of the tube alone as it is rotated to the same position as in FIG. 6.
Figure 8:
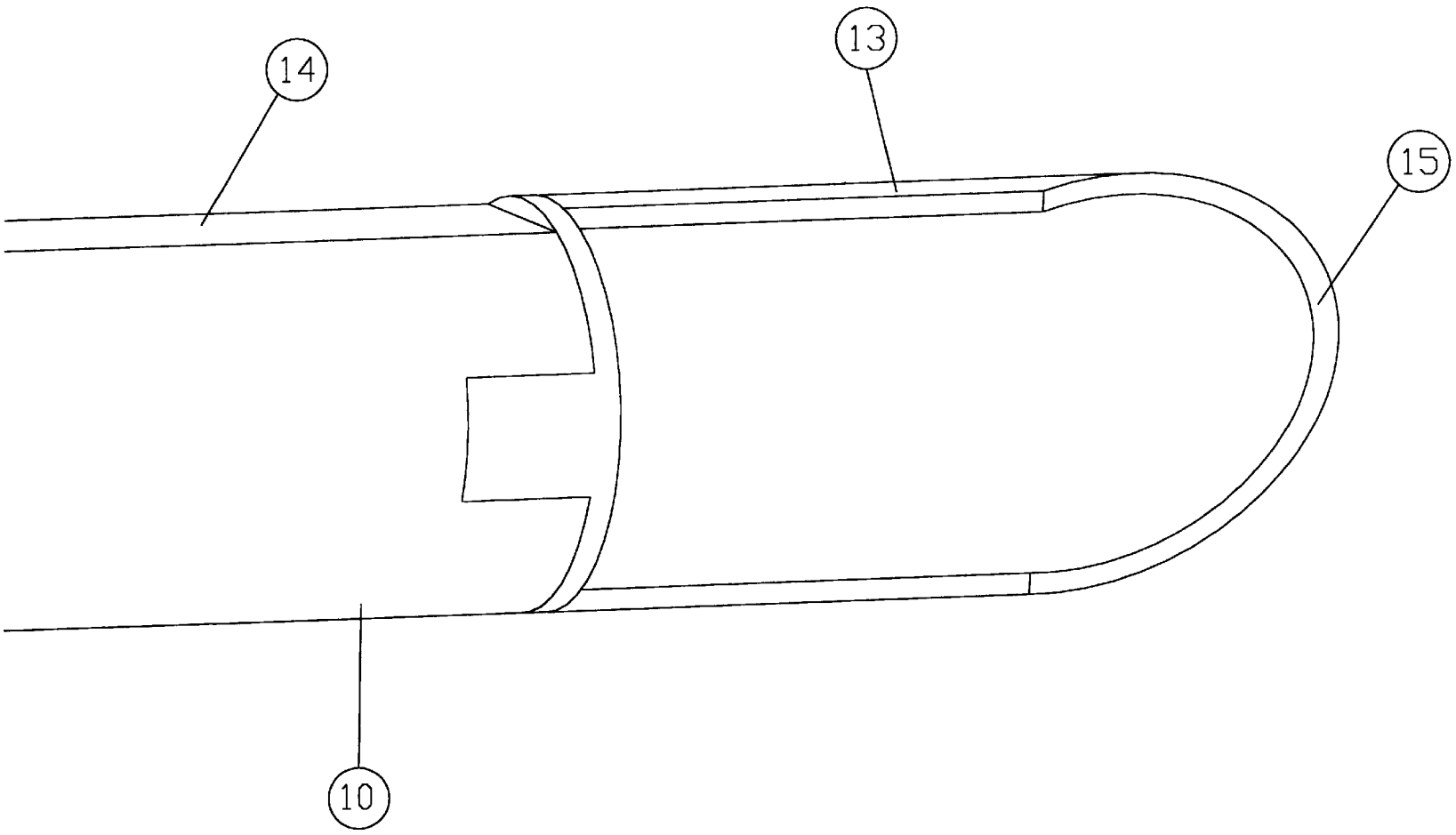
FIG. 8 is an enlarged front section of the plunger with plunger cutting head rotated so the bottom of the head is turned an eighth toward the viewer.
Figure 9:
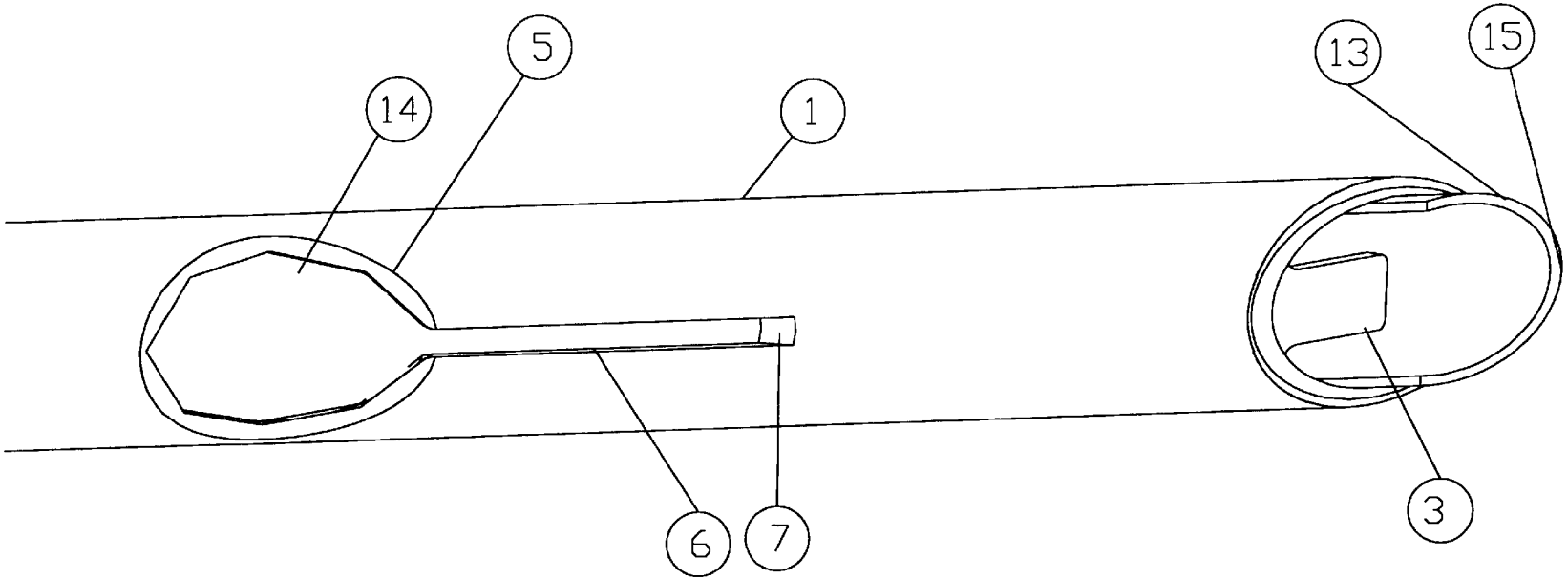
FIG. 9 is an enlarged view of the front section of the instrument with the plunger cutting head in the fully extended, penetrating position.
Figure 10:
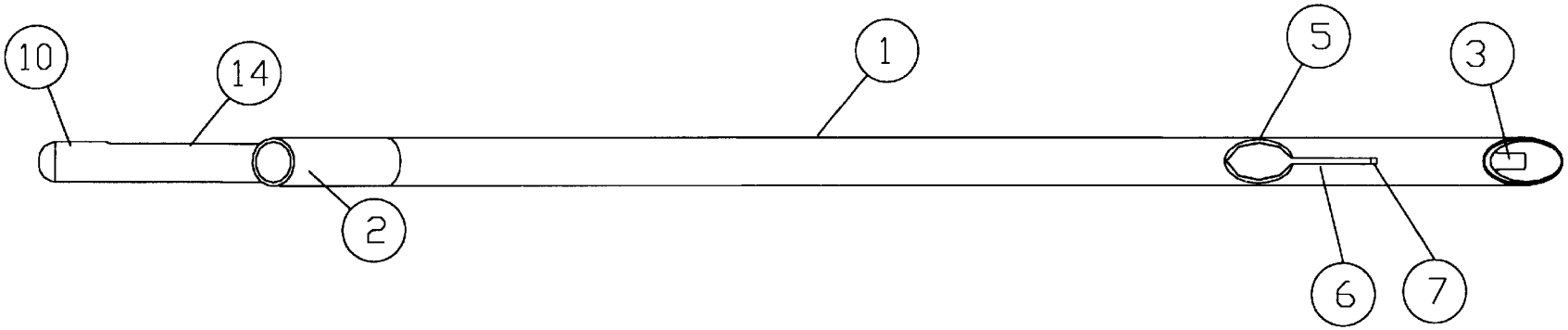
FIG. 10 is a bottom view of the instrument with plunger retracted.
Figure 11:
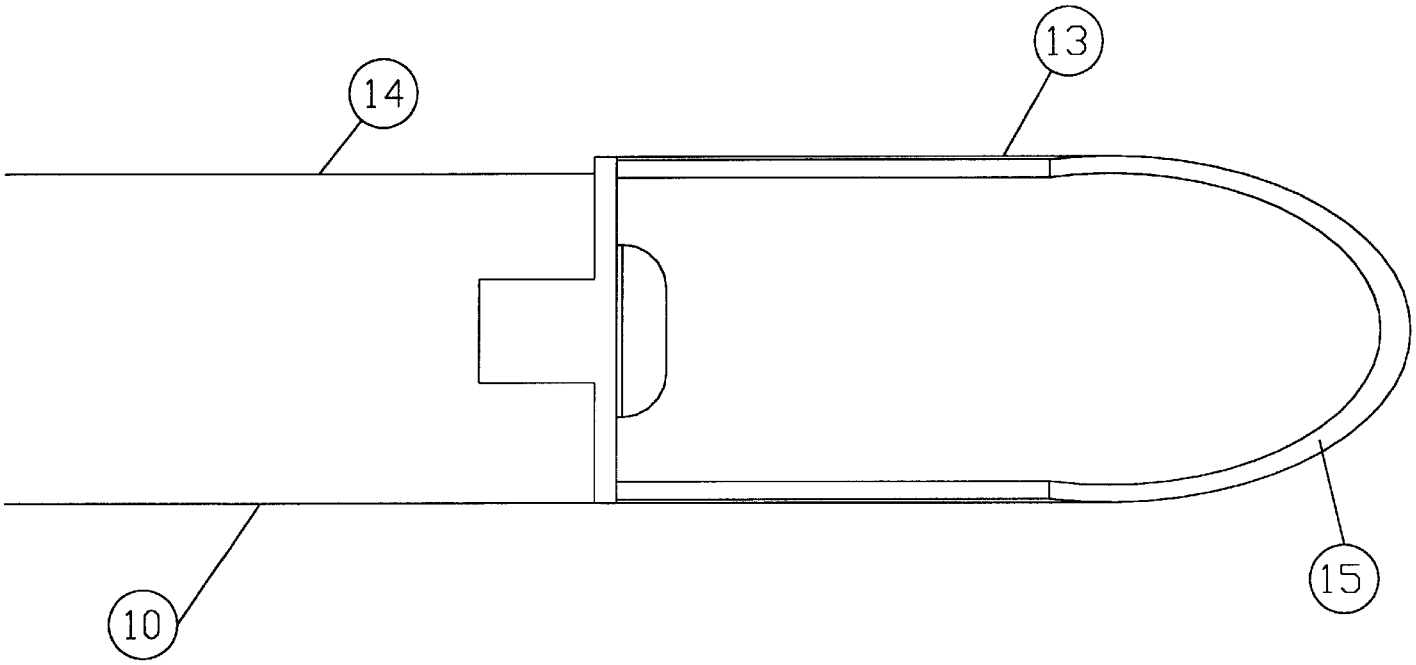
FIG. 11 is a bottom view of the front section of plunger and plunger cutting head.
Figure 12:
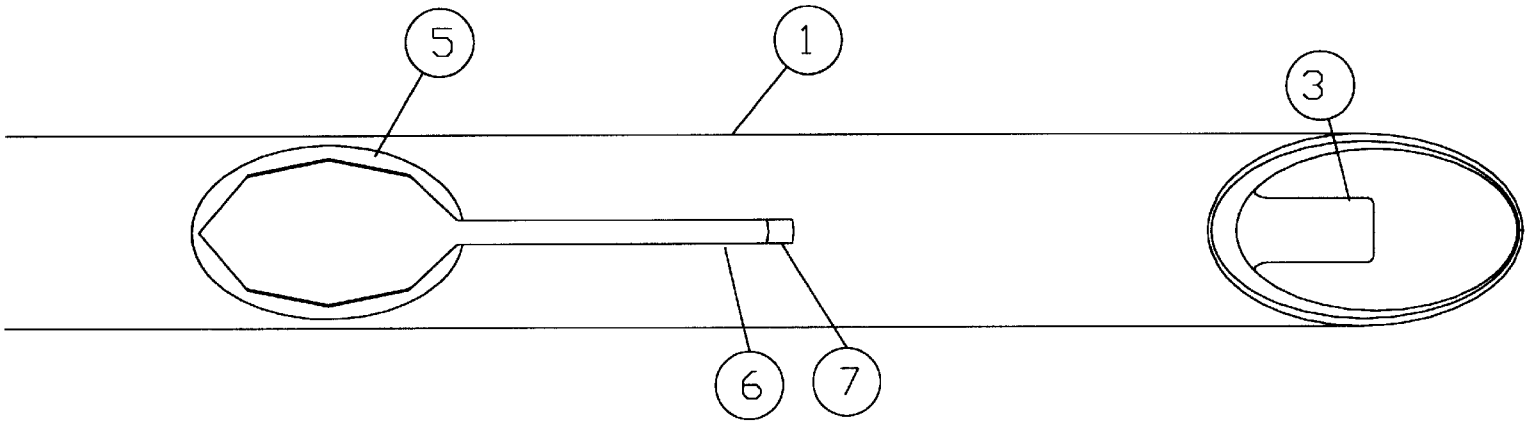
FIG. 12 is a bottom view of the front section of the tube.

With the cow properly restrained in a cattle chute, the veterinary surgeon places his free, gloved hand into the rectum. Excess feces are removed to allow better contact through the rectum between the gloved hand and the internal structures. After the perianal-vulvar area are washed and disinfected, the instrument with it's cutting blade in the retracted position is slipped fully into the vagina. Once the hand in the rectum confirms the instrument is properly pressed just on top of the cervix, the cutting blade is extended as pressure is applied to penetrate the vaginal wall dorsally and allow the front end of the instrument to enter the peritoneal cavity. Using the outside hand against the back thumb tab, the cutting blade is immediately withdrawn into the tube to prevent any unwanted damage to internal structures. An air channel is opened when the flattened surface on the side of the plunger extends out the back of the tube. Air is allowed to travel through the instrument into the peritoneal cavity to let the weight of the viscera pull the bowels down and out of the surgical field. The outside thumb is then placed onto the forward thumb tab in preparation for controlling the plunger positions. The gloved, rectal hand locates an ovary, and the outside hand positions the tube aperture against the ovary. As the thumb on the outside hand slides the plunger back, the aperture is opened for the ovary to enter the lumen of the tube. With a slight pull on the tube handle, the ovary slips into the center of the tube. It's attaching ligament slides along the communicating slot to leave the ovary inside the tube like a nailhead over the claws of a clawhammer. The gloved hand is now free to digitally inspect the area for unwanted tissues that may have inadvertently become caught. As the thumb of the outside hand presses the tab on the plunger to close the aperture, it can also judge resistance if unwanted tissue is still trapped and in danger of being cut. When the surgeon is satisfied that he is only cutting what is desired, he can chose how to best remove the ovary. Simply pulling backward will cut the ligament against the sharp edge at the end of the slot. The pushing of the plunger straight forward will shear the ovary loose to the front part of the tube against the retainer tab 3. If it is desireable to preserve the integrity of the ovary, the plunger thumb tabs 11 and 12 can be pulled free, and the plunger rotated to bring the cutting tip against the ligament in a guillotine fashion as in FIG. 5.

The procedure is repeated for the other ovary. By pressing the second ovary tightly against the instrument while opening the aperture, the first severed ovary will not fall from the tube into the peritoneal cavity. The retained air can be evacuated by an assistant pushing the abdomen up, but such air is in time easily absorbed by the patient with no apparent harm. The instrument is withdrawn, pulled apart to examine the contents, to be washed, sterilized, and reassembled for the next cow.

Summary, Ramifications, and Scope

Thus the reader can see the plunger-in-tube arrangement of this invention will provide a veterinary surgeon an effective, simple, and safe way to isolate and to restrain ovaries, unique options to safely cut the ligamentous attachments, and to retrieve the ovaries from the cow.

While my above description contains many specificities, these should not be construed as limitations on the scope of possible uses for the invention, but rather as an exemplification of one preferred embodiment thereof. Many other variations are possible. For example, in smaller animals perhaps the surgeon could use the instrument, sized appropriately, in conjunction with fiber optics to visualize instrument placement for ovariectomies or removal of other pedunculated structures. The unique cutting areas of the instrument are the only parts where metal is necessary, so the rest of the instrument can be constructed of other rigid materials such as plastic or nylon. The cutting sites could be attached by wires to electro-surgical units to cut and cauterize at the same time. The middle area of the tube could be made flexible as long as the plunger had the travel range to perform it's functions.

Use of gentle isolation and restraint of the ovary in the tube's slot should encourage modifications of the interchangeable plunger capabilities for other activities such as instrumentation for placement of ligatures or surgical clips. Putting fiber optic cables inside a plunger could let the operator actually view ovarian structures in the animal. Styllettes, hypodermic needles, and biopsy punches placed in a plunger could retreive fluids, inject fluids, or take tissue samples. A plunger might provide laser light to selectively destroy tissue. Tubes could travel through a plunger to deliver liquids or gases to freeze and destroy the ovaries or baste them in selected solutions.

Thus the scope of the invention should be determined by the appended claims and their legal equivalents, rather than by the examples given.

I claim:

1. A surgical instrument capable, avisually, of penetrating tissue walls of body cavities, and capable of allowing rapid air introduction into the same cavities for purposes of safely isolating and holding specific pedunculated tissue masses for surgical removal comprising:

an elongated, open-backed tube, partially closed on the opposite end by a partial closure structure with a hole in said tube's sidewall large enough to admit targeted tissue masses and at least one slot extending from said sidewall hole, terminating on a single, sharpened spot, to permit said tube to engulf said targeted tissue masses while leaving intact narrower, supportive and vascular attachments to the body, and to permit severing said attachments when drawn against said sharpened spot of said slot, a full length plunger, closely fitting inside said tube except for surfaces where air may pass, able to slide the entire length of said tube and equipped with attachments to properly position said plunger and equipped with a forward end-piece able to extend out from the front of the said tube contacting said partial closure structure, wherein said end-piece has sharpened edges angled to a point capable of both perforating tissue and cutting tissue along said sharpened edges.

* * * * *